US008600259B2

(12) United States Patent
Oi et al.

(10) Patent No.: US 8,600,259 B2
(45) Date of Patent: Dec. 3, 2013

(54) IMAGE FORMING APPARATUS FIXING A TONER IMAGE ON RECORDING MATERIAL WITH A FIXING PORTION HAVING A FIXING SLEEVE AND PRESSING ROLLER, AT LEAST ONE OF WHICH IS GROUNDED

(75) Inventors: Ken Oi, Suntou-gun (JP); Jun Asami, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 548 days.

(21) Appl. No.: 12/903,735

(22) Filed: Oct. 13, 2010

(65) Prior Publication Data

US 2011/0091236 A1 Apr. 21, 2011

(30) Foreign Application Priority Data

Oct. 19, 2009 (JP) ..... 2009-240789

(51) Int. Cl.
*G03G 15/00* (2006.01)

(52) U.S. Cl.
USPC ..... 399/90; 399/328; 219/216

(58) Field of Classification Search
USPC ..... 399/67, 90, 324, 328; 219/216
See application file for complete search history.

(56) References Cited

U.S. PATENT DOCUMENTS

| | | | |
|---|---|---|---|
| 7,389,079 | B2 | 6/2008 | Narahara et al. |
| 2004/0007569 | A1 | 1/2004 | Ohta |

FOREIGN PATENT DOCUMENTS

| | | |
|---|---|---|
| JP | 4-335386 | 11/1992 |
| JP | 5-040426 | 2/1993 |
| JP | 8-272245 | 10/1996 |
| JP | 2003-076181 | 3/2003 |
| JP | 2003-107940 | 4/2003 |
| JP | 2003-295639 | 10/2003 |
| JP | 2006-195003 | 7/2006 |

*Primary Examiner* — David Gray
*Assistant Examiner* — Laura Roth
(74) *Attorney, Agent, or Firm* — Fitzpatrick, Cella, Harper & Scinto

(57) ABSTRACT

An image forming apparatus includes: an image bearer bearing a toner image; a transferer transferring the toner image from the image bearer onto a recording material and including a transfer member forming a transfer nip between itself and the image bearer; and a fixer fixing portion for fixing on the recording material the transferred toner image and including a fixing sleeve, a heater contacting an inner surface of the fixing sleeve, and a pressing roller for forming a fixing nip between itself and the heater through the fixing sleeve. At least one of the fixing sleeve and the pressing roller is grounded through a first series circuit consisting of a rectifying element and a first resistance element and is grounded through a second series circuit, which is connected to the first series circuit in parallel, consisting of a capacitive element and a second resistance element.

7 Claims, 7 Drawing Sheets

IMAGE FORMING APPARATUS FIXING A TONER IMAGE ON RECORDING MATERIAL WITH A FIXING PORTION HAVING A FIXING SLEEVE AND PRESSING ROLLER, AT LEAST ONE OF WHICH IS GROUNDED

FIELD OF THE INVENTION AND RELATED ART

The present invention relates to an image forming apparatus such as a copying machine, a laser beam printer or a facsimile machine. In the image forming apparatus, a toner image is transferred onto a recording material by an image forming process of an electrophotographic type or the like and then the toner image transferred onto the recording material is fixed on the recording material. Incidentally, as the recording material, it is possible to use paper, printing paper, a transfer sheet, an OHT sheet, glossy paper, a glossy film, electrofax paper, electrostatic recording paper, and the like.

When a fixing process in which the toner image formed on the recording material by using toner of a heat-softenable resin material or the like is heated, the following problem arises. In a high-temperature and high-humidity environment, when the recording material is in a state in which water (moisture) content is large, image defect such as offset is liable to occur in a fixing nip in which the recording material is nipped between a heater and a pressing roller. This is because water vapor is generated from a water-bearing component of the recording material immediately before the fixing nip by heat of the heater, and an unfixed toner image on the recording material is blown off by air stream of the vapor to cause the image defect. For this reason, in a conventional method disclosed in Japanese Laid-Open Patent Application (JP-A) Hei 8-272245 and Japanese Patent No. 3090989, the image defect due to the vapor generated from the recording material in the neighborhood of the heater has been prevented. Specifically, in JP-A Hei 8-272245, the pressing roller was grounded and a voltage has been applied to a fixing sleeve. Further, in Japanese Patent No. 3090989, a self bias has been generated at a surface of the fixing sleeve by inserting a rectifying element between the fixing sleeve and a grounding position without providing a high-voltage circuit for applying the voltage to the fixing sleeve. By these methods, the unfixed toner image on the recording material was directed toward the recording material and fixed on the recording material by the applied voltage or by the self bias, so that the occurrence of the image defect due to the blowing off of the unfixed toner image by the vapor was prevented.

FIG. 8 shows a principal part of an image forming apparatus in the case where a potential is generated on the fixing sleeve by the self bias. A photosensitive drum has a photosensitive layer at its surface. A transfer roller 18 supplies a transfer voltage to a recording material P. In a transfer nip formed between the photosensitive drum 15 and the transfer roller 18, an unfixed toner image M is transferred from the photosensitive drum 15 onto the recording material P and at the same time, the recording material P is nip-conveyed to a fixing nip N. A heater 71 disposed in the fixing nip N is driven and controlled by a CPU, so that the heater 71 generates heat to heat the unfixed toner image M on the recording material P in the fixing nip N. Here, a fixing sleeve 72 is grounded, and a diode 109 is connected between the fixing sleeve 72 and the grounding position. As a result, when electric charges are generated by sliding friction among the fixing sleeve 72, the pressing roller 73 and the recording material P, the electric charges are rectified by the diode 109, so that the self bias is applied to the surface of the fixing sleeve 72. By the self bias, the unfixed toner image M on the recording material P is directed toward the recording material P and is fixed on the recording material P, so that the occurrence of the image defect due to the blowing-off of the unfixed toner image M by the vapor is prevented.

The heater 71 incorporated in the fixing sleeve 72 in the fixing nip N generates heat by applying an AC voltage to a heat generating resistor. In such a heater 71, glass for coating the heat generating resistor acts as a capacitor. For this reason, when the AC voltage is applied to the heat generating resistor, the AC voltage is transmitted to the fixing nip N through the fixing sleeve 72.

When the water content of the recording material P is increased, impedance is lowered. Further, in, the case where one sheet of the recording material P is simultaneously nipped in the transfer nip T and in the fixing nip N, the AC voltage transfer to the fixing nip N is transmitted to the transfer nip T through the recording material P. Then, the AC voltage transmitted to the transfer nip T fluctuates a transfer voltage for transferring the unfixed toner image M in the transfer nip T, thus causing transfer non-uniformity. As a result, the image defect during transfer such that a striped pattern (density non-uniformity) of the unfixed toner image M formed on the recording material P with respect to a sub-scan direction of the unfixed toner image M is caused is generated.

SUMMARY OF THE INVENTION

A principal object of the present invention is to provide an image forming apparatus capable of suppressing an occurrence of image defect during transfer due to an AC voltage transmitted from a fixing nip to a transfer nip while retaining a self bias in at least one of rotatable members in pair in the fixing nip.

According to an aspect of the present invention, there is provided an image forming apparatus comprising:

an image bearing member for bearing a toner image;

a transfer portion for transferring the toner image from the image bearing member onto a recording material, the transfer portion including a transfer member for forming a transfer nip between itself and the image bearing member; and a fixing portion for fixing on the recording material the toner image transferred on the recording material, the fixing device including a fixing sleeve, a heater contacted to an inner surface of the fixing sleeve, and a pressing roller for forming a fixing nip between itself and the heater through the fixing sleeve, wherein at least one of the fixing sleeve and the pressing roller is grounded through a first series circuit consisting of a rectifying element and a first resistance element and is grounded through a second series circuit, which is connected to the first series circuit in parallel, consisting of a capacitative element and a second resistance element.

According to another aspect of the present invention, there is provided an image forming apparatus comprising:

an image bearing member for bearing a toner image;

a transfer portion for transferring the toner image from the image bearing member onto a recording material, the transfer portion including a transfer member for forming a transfer nip between itself and the image bearing member; and a fixing portion for fixing on the recording material the toner image transferred on the recording material, the fixing device including a fixing sleeve, a heater contacted to an inner surface of the fixing sleeve, and a pressing roller for forming a fixing nip between itself and the heater through the fixing sleeve, wherein at least one of the fixing sleeve and the pressing roller is grounded through a series circuit consisting of a resistance element and a parallel circuit consisting of a capacitative element and a rectifying element.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 4(*a*) and 4(*b*) are equivalent circuit diagrams in which only an AC voltage of a heater is focused on.

Hereinbelow, embodiments for carrying out the present invention will be described with reference to the drawings. However, dimensions, materials, shapes, relative positions, and the like of constituent parts described in the following embodiments do not limit the scope of the present invention unless otherwise specified particularly.

Embodiment 1

(Image Forming Apparatus)

Figure 1:
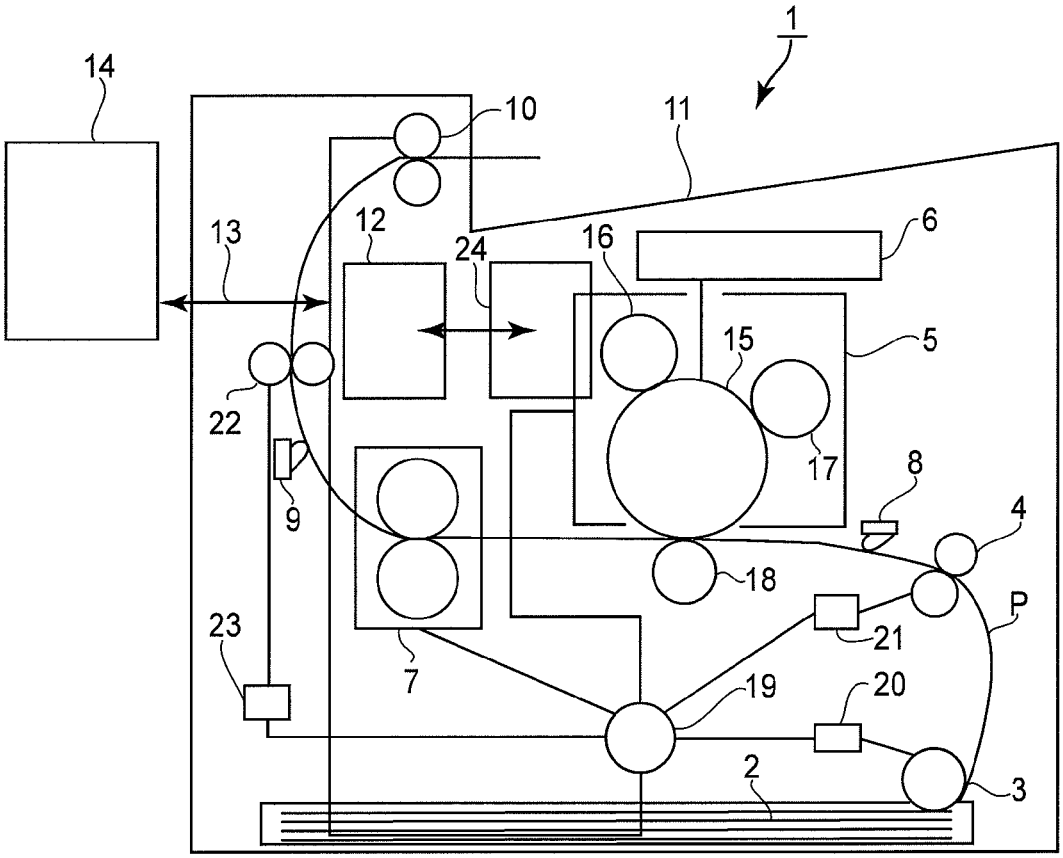
FIG. 1 is a schematic structural view of an image forming apparatus according to Embodiment 1.

FIG. 1 is a schematic structural view showing an example of an image forming apparatus according to this embodiment of the present invention. The image forming apparatus is a laser beam printer. In a laser beam printer main assembly 1, first, a recording material P is fed from a cassette 2, which accommodates the recording material P, by a sheet feeding roller 3. On a downstream side of the sheet feeding roller 3 with respect to a recording material conveyance direction, the recording material P is conveyed in a synchronous manner by a registration roller pair 4. On the downstream side of the registration roller pair 4, a toner image is formed on the recording material P, on the basis of laser light emitted from a laser scanner 6, by an image forming portion 5. On the downstream side of the image forming portion 5, the toner image formed on the recording material P is fixed by a fixing device 7 in a fixing nip. On an upstream side of the image forming portion 5, the fed recording material P is detected by a top sensor 8. On the downstream side of the fixing device 7, a conveyance state of the recording material P at a sheet discharging portion is detected by a sheet discharge sensor 9 and then the recording material P is discharged by sheet discharging rollers 10, so that the recording material P on which recording has been completed is stacked on a sheet discharge tray 11.

The laser scanner 6 in the main assembly 1 emits the lower light modulated on the basis of an image signal sent from an external device 14, such as a personal computer, connected with a video controller 12 through an interface 13. The image forming portion is constituted by a photosensitive drum 15, a primary charging roller 16, a developing roller 17, a transfer roller 18, and the like which are members necessary for a known electrophotographic process. In the image forming portion 5, the surface of the photosensitive drum 15 is primary-charged by the primary charging roller 16 and the charged surface is irradiated with the laser light emitted from the laser scanner 6, so that an electrostatic latent image is formed. The electrostatic latent image formed on the photosensitive drum 15 is developed into a toner image with toner supplied by the developing roller 17. The toner image formed on the photosensitive drum 15 (image bearing member) is transferred onto the recording material P, which is conveyed from the registration roller pair 4 in the synchronous manner, in a transfer nip formed between the transfer roller 18 and the photosensitive drum 15. A main motor 19 supplies a driving force to the sheet feeding roller 3 through a sheet feeding solenoid 20, supplies the driving force to the registration roller pair 4 through a registration clutch 21, and supplies the driving force to a conveying roller pair 22 through a conveying clutch 23. Further, the main motor 19 also supplies the driving force to the respective units of the image forming portion 5 including the photosensitive drum 15, and the fixing device 7 and the sheet discharging roller 10. An engine power unit 24 includes a power (voltage source) circuit, a high-voltage circuit, a CPU, and a peripheral circuit, and effects control of the electrophotographic process by the laser scanner 6, the high-voltage circuit portion (image forming portion 5) and the fixing device 7, and effects control of conveyance of the recording material P in the main assembly 1.

(Principal Part Constitution)

Figure 2:
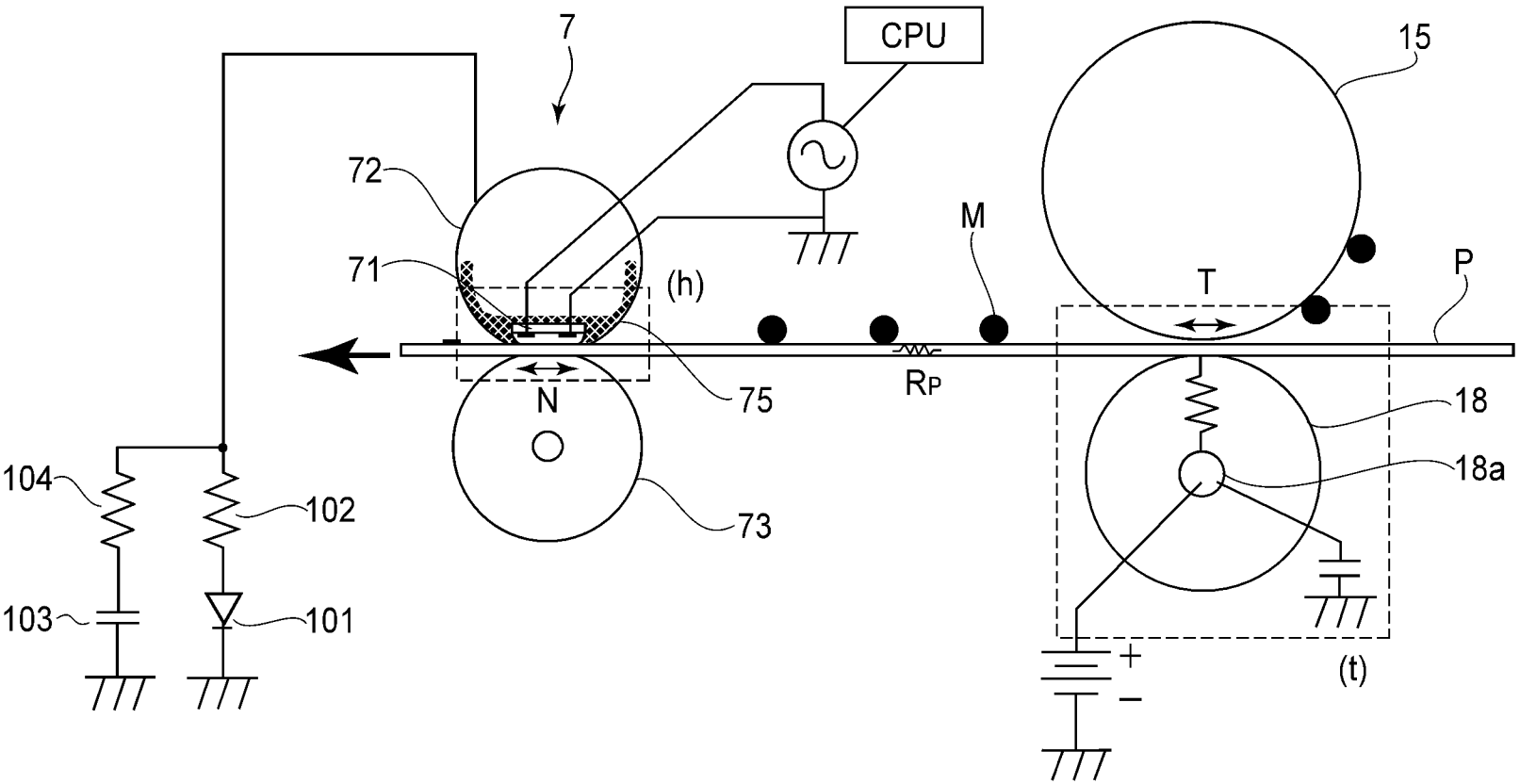
FIG. 2 is a schematic structural view of a transfer nip and a fixing device in Embodiment 1.

The present invention is characterized by the transfer nip and the fixing device which are part of the image forming portion. FIG. 2 shows a schematic structure of a transfer nip T and the fixing device 7 in this embodiment. The transfer nip T is created by the photosensitive drum 15 and the transfer roller 18 between which the recording material P is nip-conveyed, and an unfixed toner image M is transferred from the photosensitive drum 15 onto the recording material P by applying a transfer voltage. The transfer roller 18 is shaft-supported by a transfer roller shaft 18*a* to which the transfer voltage which is a positive voltage is to be applied.

On the other hand, the fixing device 7 includes a heater 71 which includes a heat generating resistor 71*a* for generating heat by a supplied AC voltage, and a pair of rotatable members, for nip-conveying the recording material P, consisting of a fixing sleeve 72 and a pressing roller 73. The heat generating resistor 71*a* in the heater 71 is coated with glass 74. The heater 71 is fixed inside the fixing sleeve 72 by stay 75 and opposes the pressing roller 73 through the fixing sleeve 72. A portion formed by using the heater 71, the fixing sleeve 72 and the pressing roller 73 so that the heater 71 and the pressing roller 73 oppose each other through the fixing sleeve 72 is a fixing nip N. In the fixing nip N, during nip-conveyance of the recording material P by the fixing sleeve 72 and the pressing roller 73, the unfixed toner image M on the recording material P is heated by heat of the heat generating resistor 71*a* in the heater 71 and the recording material P is pressed. As a result, in the fixing nip N, the unfixed toner image M transferred on the recording material P is fixed on the recording material P.

Here, a conveyance distance of the recording material P between the transfer nip T and the fixing nip N in the main assembly 1 in this embodiment is shorter than a length of a single sheet of the recording material P with respect to the conveyance direction of the recording material P. For this reason, as shown in FIG. 2, when downstream-side portion of the single sheet of the recording material P with respect to the conveyance direction is subjected to fixing in the fixing nip N, an upstream-side portion of the same recording material P with respect to the conveyance direction is subjected to transfer in the transfer nip T. That is, the single sheet of the recording material P is simultaneously nipped in the transfer nip T and the fixing nip N.

The heater 71 of the fixing device 7 is driven and controlled by the CPU and generates heat by applying an AC voltage to the heat generating resistor 71*a*. In the heater 71, the heat generating resistor 71*a* is coated with glass 74. The glass 74 which coats the heat generating resistor 71*a* acts as a capacitor in an equivalent circuit. For this reason, when the AC voltage is applied to the heat generating resistor 71*a*, by the influence of the glass 74 acting as the capacitor, the AC voltage is transmitted to the fixing nip N through the fixing sleeve 72.

When the water (moisture) content of the recording material P is increased, impedance of the recording material P is lowered. Further, in the case where the single sheet of the recording material P is simultaneously nipped in the transfer nip T and the fixing nip N, the AC voltage transmitted to the fixing nip N is transmitted to the transfer nip T through the recording material P. Then, the AC voltage transmitted to the transfer nip T fluctuates a transfer voltage for transferring the unfixed toner image M in the transfer nip T, thus causing transfer non-uniformity. As a result, image defect during the transfer such that a striped pattern (density non-uniformity) of the unfixed toner image M formed on the recording material P by the transfer with respect to a sub-scanning direction is generated is caused.

In a conventional fixing device, in order to prevent an occurrence of image defect due to blowing-off of the unfixed toner image on the recording material by air stream of vapor generated from a water-bearing component of the recording material by the heat of the heater immediately before the fixing nip, a self bias is generated at the surface of the fixing sleeve. That is, the self bias is generated so that the toner of the unfixed toner image charged by the transfer in the transfer nip is directed toward the recording material in the fixing nip. The self bias can be generated by connecting a diode as a rectifying element and a carbon resistance as a resistance element in series between the fixing sleeve and a grounding position.

Here, the diode carries formed-direction electric charges to the grounding position and accumulates reverse-direction electric charges in the fixing sleeve when the fixing sleeve surface is charged by sliding friction among the fixing sleeve, the pressing roller and the recording material. Further, when an amount of the accumulated electric charges is not less than a predetermined value, breakdown is caused and thus the self bias is retained. However, only by disposing the diode, an excessive current passes through the diode to break the diode in some cases. For this reason, the diode is connected with the carbon resistance in series and thus passage of the excessive current through the diode is prevented.

The present inventors has studied that a capacitor as a capacitative element is connected between the fixing sleeve and the grounding position in parallel to the diode in order to suppress the image defect during the transfer caused due to the AC voltage transmitted from the fixing nip to the transfer nip. As a result, the AC voltage transmitted from the fixing nip to the transfer nip was able to be removed but it was found that a lowering in potential amount of the self bias was caused to occur.

The self bias utilizes not only the electric charges supplied by the sliding friction among the fixing sleeve, the pressing roller and the recording material but also electric charges supplied by an AC voltage connected through the glass from the AC voltage supplied to the heat generating resistor in the heater. For this reason, when only the capacitor was disposed for removing the AC voltage transmitted from the fixing nip to the transfer nip, a problem that the self bias was lowered occurred.

Therefore, in this embodiment, between the grounded fixing sleeve and the grounding position, a diode 101 as the rectifying element and a first carbon resistance 102 as a first resistance element are connected in series. At the same time, in parallel to the diode 101 and the first carbon resistance 102, a capacitor 103 as the capacitance element and a second carbon resistance 104 as a second resistance element are connected in series.

The diode 101 generates, on the surface of the fixing sleeve 72, the self bias by which the toner of the toner image charged by the transfer in the transfer nip is directed toward the surface of the recording material P in the fixing nip N. The first carbon resistance 102 is an insulation resistance for the self bias. The capacitor 103 removes the AC voltage generated in the transfer nip N from the AC voltage supplied to the heat generating resistor 71*a*. The second carbon resistance 104 sets a self bias value at the surface of the fixing sleeve 72. In this embodiment, the self bias value at the surface of the fixing sleeve 72 is required to be a DC voltage of about −50 V or more.

Figure 3:
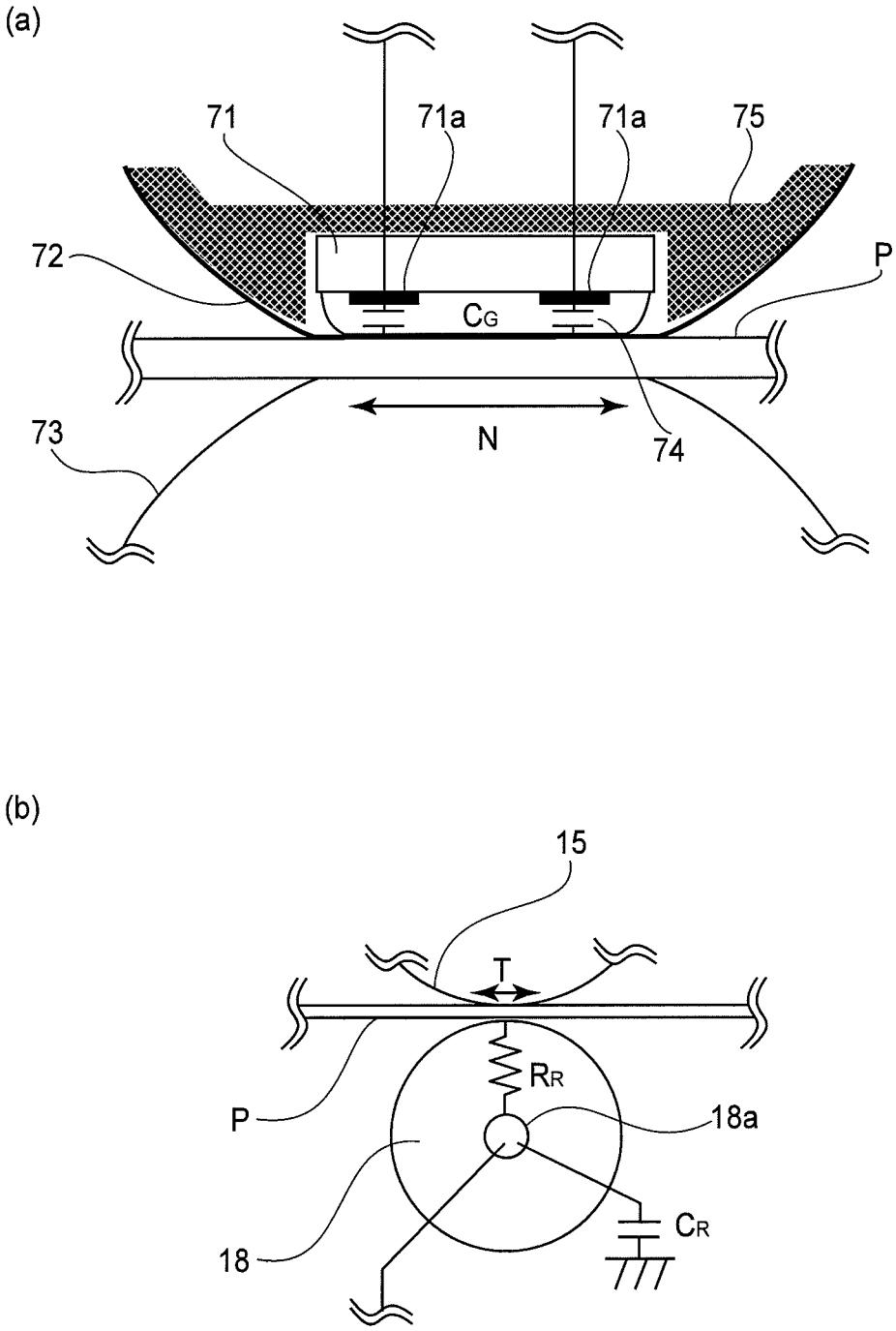
FIGS. 3(*a*) and 3(*b*) are principal part structural views of a fixing nip and the transfer nip, respectively, in Embodiment 1.

FIG. 3(*a*) is an enlarged view of an area (h) in the neighborhood of the heater 71 shown in FIG. 2, and FIG. 3(*b*) is an enlarged view of an area (t) in the neighborhood of the transfer roller 18 shown in FIG. 2. Here, $C_G$ represents capacitance formed between the heat generating resistor 71*a* and the surface of the recording material P through the glass 74 with which the heat generating resistor 71*a* of the heater 71 is coated. $R_R$ represents a resistance value between the surface of the transfer roller 18 and a transfer roller shaft 18*a*. $C_R$ represents stray capacitance of the transfer roller shaft 18*a* with respect to ground potential. Incidentally, the influence of the fixing sleeve 72 on the capacitance $C_G$ is small and thus the capacitance of the fixing sleeve 72 is neglected.

The resistance values and capacitance values of the recording material P and the like in a high-temperature and high-humidity environment are, e.g., as follows. The resistance value $R_R$ is about 80 MΩ. The stray capacitance $C_R$ is about 10 pF. The capacitance $C_G$ is about 850 pF. The resistance value of the first carbon resistance 102 is about 15 MΩ. The capacitance value of the capacitor 103 which is a voltage fluctuation value at which a transfer voltage fluctuation in the transfer nip T is permitted with respect to an image quality is about 4700 pF. The capacitance value of the capacitor 103 may preferably be about 1500 pF or more and about 0.01 μF or less. The resistance value of the second carbon resistance 104 is about 1.5 MΩ. The resistance value of the second carbon resistance 104 may preferably be about 1 MΩ or more and about 3.3 MΩ or less. The capacitance value of the capacitor 103 and the resistance value of the second carbon resistance 104 may preferably be set in the following manner. That is, these values may preferably be set so that the self bias with respect to the surface of the fixing sleeve 72 which has been grounded is adjusted in a range in which the toner of the unfixed toner image charged by the transfer in the transfer nip T is not detached from the recording material P in the fixing nip N.

Further, a volume resistivity of the recording material P, such as recycled paper, which has taken up moisture in the high-humidity environment is lowered to about $2\times10^8$ Ω·cm. This value corresponds to about 300 MΩ when the value is converted into a resistance value of A4-sized paper (297 mm×210 mm) having a thickness of 0.1 mm. A length of the recording material P between the fixing nip N and the transfer nip T is about 60 mm, so that a resistance value $R_P$ of the recording material is about 60 MΩ.

Figure 4:
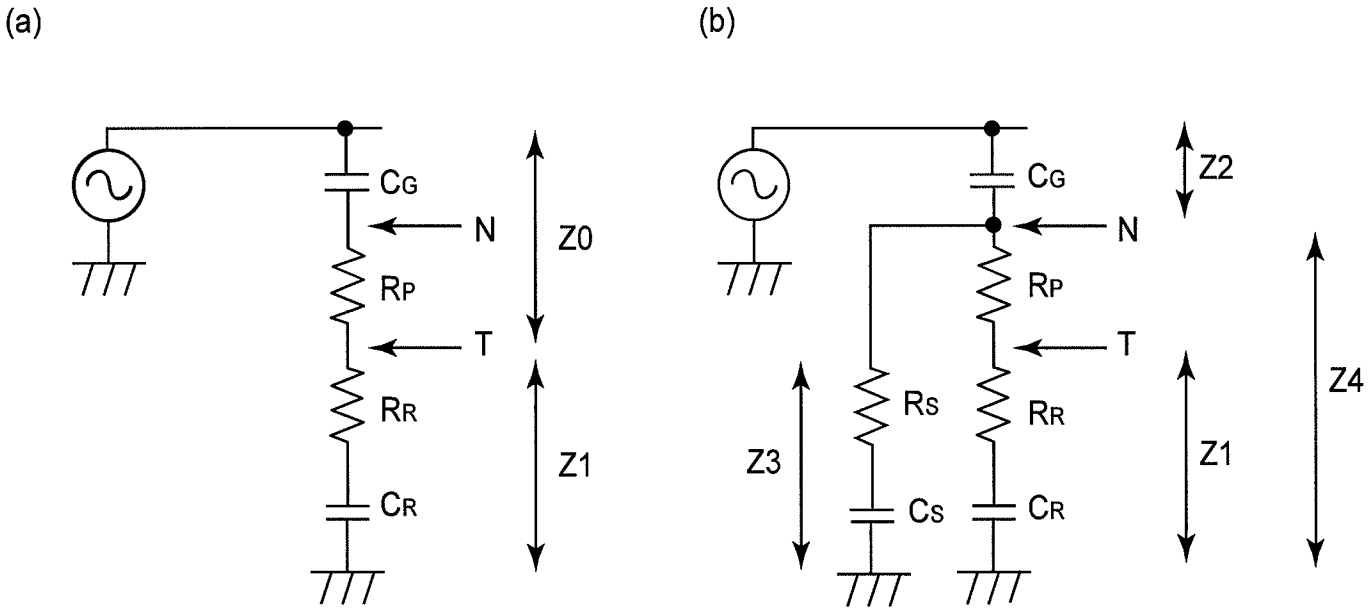

FIG. 4(*a*) is an equivalent circuit in a conventional constitution when only the AC voltage of the heater 71 is focused on, and FIG. 4(B) is an equivalent circuit in this embodiment when only the AC voltage of the heater 71 is focused on. These equivalent circuits are constituted by the capacitance $C_G$ of the glass 74, the resistance value $R_P$ of the recording material P, the resistance value $R_R$ of the transfer roller 18, the stray capacitance $C_R$ of the transfer roller 18, the capacitance $C_S$ of the capacitor 103, and the resistance value $R_S$ of the second carbon resistance 104. Incidentally, the diode 101 and the first carbon resistance 102 for insulation, which generate the self bias, provide large impedance, so that the diode 101 and the first carbon resistance 102 are neglected in the above equivalent circuits. An attenuation factor in the transfer nip T with respect to the entire impedance from input to the ground potential in each of the equivalent circuits can be calculated from a ratio between synthetic impedance Z0 of $C_G$ and $R_P$ and synthetic impedance Z1 of $C_R$ and $R_R$, and a frequency f of the AC voltage.

Here, in the case where the frequency f of the AC voltage is, e.g., 50 Hz, the synthetic impedances in the equivalent circuit in the conventional constitution (FIG. 4(*a*)) are determined by formulas (1) and (2) shown below, and Z1/(Z0+Z1) is 0.84. That is, it is understood that the attenuation factor in the transfer nip T with respect to the entire impedance from the input to the ground potential in the equivalent circuit in the conventional constitution is about 80%.

$$Z0=\sqrt{R_P^2+(1/2\pi fC_G)^2} \quad (1)$$

$$Z1=\sqrt{R_R^2+(1/2\pi fC_R)^2} \quad (2)$$

In this embodiment, the capacitor 103 and the second carbon resistance 104 are connected, so that the attenuation factor in the fixing nip N with respect to the entire impedance from the input to the ground potential in the equivalent circuit is determined in the following manner. In the case where, the impedance of $C_G$ is Z2, the synthetic impedance of $C_S$ and $R_S$ is Z3, and the synthetic impedance of $C_R$ and $R_R$ is Z4, the respective impedance values are determined by formulas (3), (4) and (5) shown below. Further, $Z2/\{Z2+(1/Z3+1/Z4)^{-1}\}$ is about 0.30. That is, in this embodiment, it is understood that the attenuation factor in the fixing nip N with respect to the entire impedance in the equivalent circuit is about 30%.

$$Z2=1/2\pi fC_G \quad (3)$$

$$Z3=\sqrt{R_s^2+(1/2\pi fC_S)^2} \quad (4)$$

$$Z4=\sqrt{(R_R+R_P)^2+(1/2\pi fC_R)^2} \quad (5)$$

From the attenuator factor in the fixing nip N with respect to the entire impedance in the equivalent circuit in this embodiment, the attenuation factor in the transfer nip T with respect to the entire impedance in the equivalent circuit in this embodiment is determined by a ratio between the resistance value $R_P$ and the synthetic impedance Z1. From respective values, Z1/(Z1+$R_P$) is about 0.257. That is, it is understood that the attenuation factor in the transfer nip T with respect to the entire impedance from the input to the ground potential in the equivalent circuit in this embodiment is about 25%.

Thus, in this embodiment, the attenuation factor in the transfer nip T with respect to the entire impedance in the equivalent circuit is smaller than that in the convention constitution in which the capacitor 103 and the second carbon resistance 104 are not connected. For this reason, compared with the conventional constitution, in this embodiment, the AC voltage of the heater 71 as the input is not readily transmitted to the transfer nip T.

Figure 5:
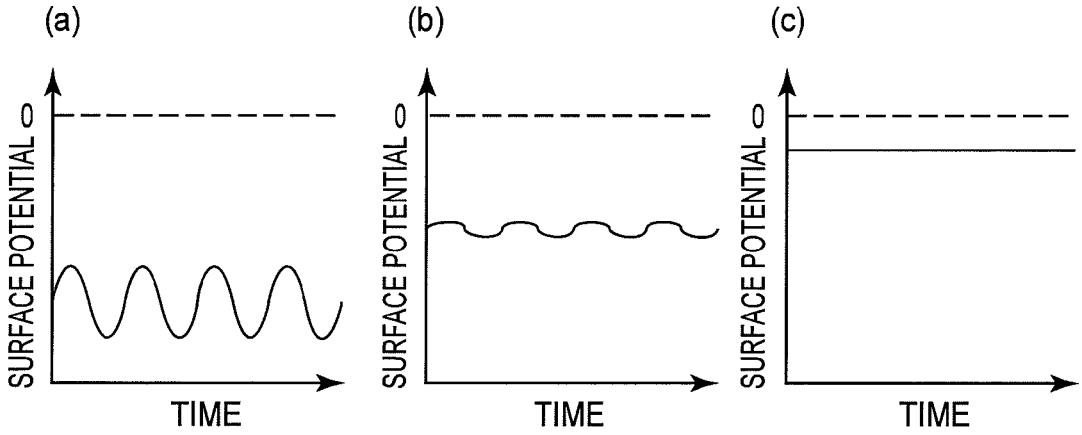
FIGS. 5(*a*), 5(*b*) and 5(*c*) are graphs each showing a potential relationship on a fixing sleeve surface.

FIG. 5(*a*) is a graph showing a potential relationship on the fixing sleeve 72 surface in the conventional constitution. FIG. 5(*b*) is a graph showing the potential relationship on the fixing sleeve 72 surface in this embodiment. FIG. 5(*c*) is a graph showing the potential relationship on the fixing sleeve 72 surface when the resistance value $R_S$ of the second carbon resistance 104 is 0Ω.

The self bias is formed by the potential supplied by the sliding friction among the fixing sleeve 72, the pressing roller 73 and the recording material P and by the potential by the AC voltage connected from heater 71 through the glass 74. For that reason, compared with the case of the conventional constitution (FIG. 5(*a*)), in the case where only the capacitor 103 connected (FIG. 5(*c*)), an AC voltage-removing effect is large but the lowering in potential amount of the self bias also becomes large.

On the other hand, in this embodiment shown in FIG. 5(*b*), the resistance value $R_S$ of the second carbon resistance 104 is set so that a necessary self bias value can be obtained by adjusting the lowering in self bias potential amount. For this reason, it is possible to achieve the removing effect of the AC voltage connected from the heater 71 through the glass 74 while suppressing the lowering in self bias potential amount. That is, during the transfer, disturbance of the AC voltage transmitted from the fixing nip N to the transfer nip T can be removed while maintaining a sufficient image quality.

Thus, while maintaining the self bias on the fixing sleeve 72 in the fixing nip N, the image defect during the transfer due to the AC voltage transmitted from the fixing nip N to the transfer nip T can be suppressed

Embodiment 2

Figure 6:
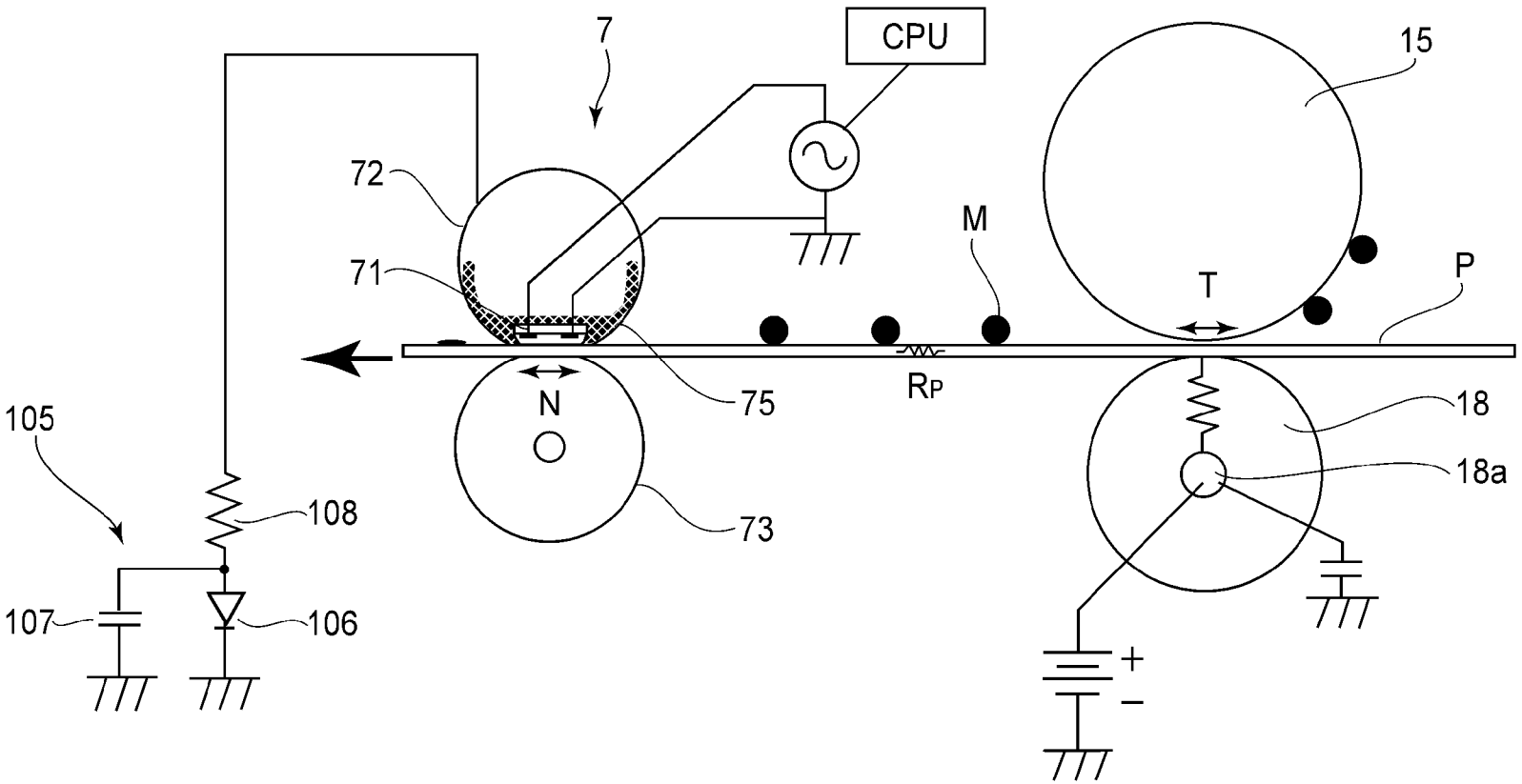
FIG. 6 is a schematic structural view of a transfer nip and a fixing device in Embodiment 2.
Figure 8:
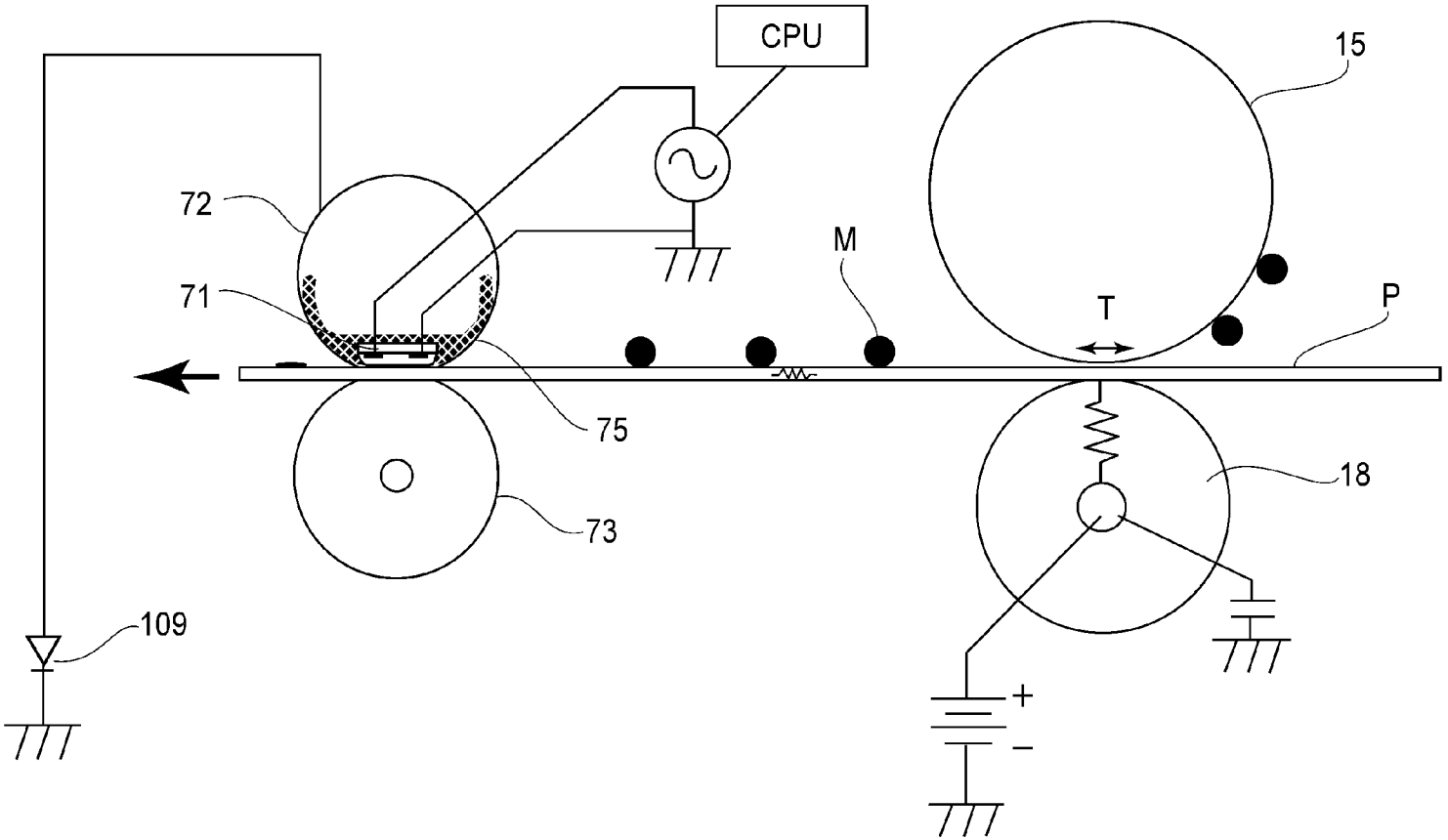
FIG. 8 is a schematic structural view of a transfer nip and a fixing device in a conventional constitution.

FIG. 6 shows a schematic structure of a transfer nip T and the fixing device 7 in this embodiment. Incidentally, in this embodiment, a portion similar to that in Embodiment 1 will be omitted from the description, and a portion different from that in Embodiment 1 will be described. In this embodiment, between the grounded fixing sleeve and the grounding position, a parallel circuit 105 in which a capacitor 107 as the capacitative element and a diode 106 as the rectifying element are connected parallel, and a carbon resistance 108 as a resistance element are connected in series.

The diode 106 generates, on the surface of the fixing sleeve 72, the self bias by which the toner of the toner image charged by the transfer in the transfer nip is directed toward the surface of the recording material P in the fixing nip N. The capacitor 107 removes the AC voltage in the transfer nip N. The carbon resistance 108 sets a self bias potential at the surface of the fixing sleeve 72 and ensures insulation between the AC voltage and the ground potential.

Compared with Embodiment 1, in this embodiment, in the case where the distance between the fixing nip N and the transfer nip T is long, e.g., when the distance between the fixing nip N and the transfer nip T is 200 mm, the resistance value of the recording material P which is nipped in both of the fixing nip N and the transfer nip T and is in the high-temperature and high-humidity environment is about 200 MΩ. In this embodiment, in order to obtain the same attenuation factor as in Embodiment 1 in the transfer nip T with respect to the entire impedance, the resistance value of the carbon resistance 108 is about 2.3 MΩ, at which it becomes possible to ensure insulation from the ground potential. In this case, the capacitance value of the capacitor 107 may preferably be about 3300 pF or more and about 0.01 μF or less. The resistance value of the carbon resistance 108 may preferably be about 1 MΩ or more and about 7 MΩ or less. The capacitance value of the capacitor 107 and the resistance value of the carbon resistance 108 may preferably be set in the following manner. That is, these values may preferably be set so that the self bias with respect to the surface of the fixing sleeve 72 which has been grounded is adjusted in a range in which the toner of the unfixed toner image charged by the transfer in the transfer nip T is not detached from the recording material P in the fixing nip N.

Figure 7:
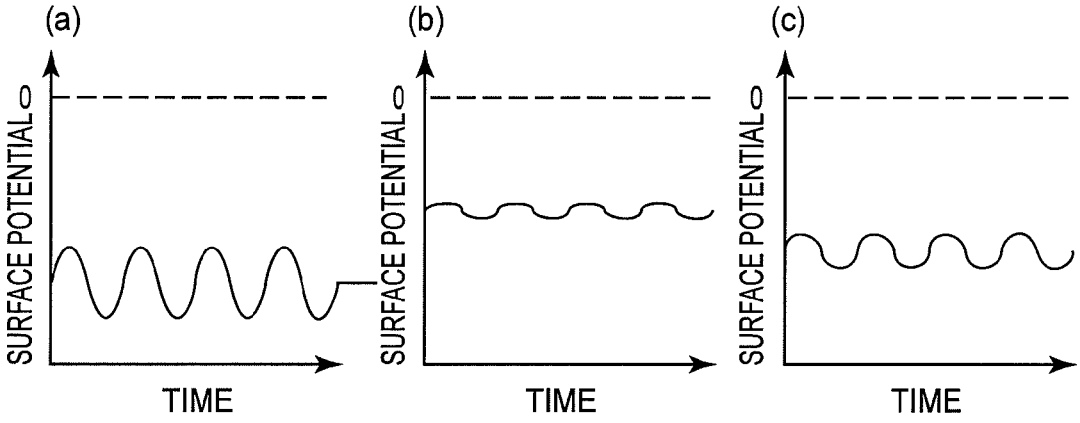
FIGS. 7(*a*), 7(*b*) and 7(*c*) are graphs each showing a potential relationship on a fixing sleeve surface.

FIG. 7(*a*) is a graph showing a potential relationship on the fixing sleeve 72 surface in the conventional constitution. FIG. 7(*b*) is a graph showing the potential relationship on the fixing sleeve 72 surface in Embodiment 1. FIG. 7(*c*) is a graph showing the potential relationship on the fixing sleeve 72 surface in this embodiment.

The resistance value of the carbon resistance 108 is larger than that of the second carbon resistance 104 in Embodiment 1, so that the AC voltage value on the fixing sleeve 72 surface is large and thus the self bias value on the fixing sleeve 72 surface is also large. On the other hand, the amount of the removed AC voltage is decreased but the resistance value of the recording material P is larger than that of the recording material P in Embodiment 1, so that the attenuation factor of the AC voltage in the transfer nip T is similar to that in Embodiment 1.

Thus, depending on the distance between the fixing nip N and the transfer nip T, it is possible to achieve commonalty between the resistance element for setting the self bias and the resistance element for ensuring the insulation between the AC voltage and the ground potential. As a result, the number of elements can be reduced, so that an effect of reducing the cost can be obtained.

Incidentally, in this embodiment, while maintaining the self bias on the fixing sleeve 72 in the fixing nip N, the circuit for suppressing the image defect during the transfer due to the AC voltage transmitted from the fixing nip N to the transfer nip T was connected. However, the same circuit may be connected to the pressing roller 73 and may also be connected to both of the fixing sleeve 72 and the pressing roller 73.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 240789/2009 filed Oct. 19, 2009, which is hereby incorporated by reference.

What is claimed is:

1. An image forming apparatus comprising:

an image bearing member configured to bear a toner image;

a transfer portion configured to transfer the toner image from said image bearing member onto a recording material, said transfer portion including a transfer member configured to form a transfer nip between itself and said image bearing member; and a fixing portion configured to fix on the recording material the toner image transferred on the recording material, said fixing portion including a fixing sleeve, a heater contacted to an inner surface of the fixing sleeve, and a pressing roller configured to form a fixing nip between itself and the heater through the fixing sleeve, wherein at least one of the fixing sleeve and the pressing roller is grounded through a first series circuit consisting of a rectifying element and a first resistance element and is grounded through a second series circuit, which is connected to the first series circuit in parallel, consisting of a capacitive element and a second resistance element.

2. An image forming apparatus according to claim 1, wherein the distance between the transfer portion and the fixing portion is shorter than the length of the recording material with respect to the conveyance direction of the recording material.

3. An image forming apparatus according to claim 2, wherein the impedance of the first series circuit is larger than the impedance of the second series circuit.

4. An image forming apparatus according to claim 3, wherein the capacitance value of the capacitive element is 1500 pF or more and 0.01 μF or less, and the resistance value of the second resistance element is 1 MΩ or more and 3.3 MΩ or less.

5. An image forming apparatus comprising:

an image bearing member configured to bear a toner image;

a transfer portion configured to transfer the toner image from said image bearing member onto a recording material, said transfer portion including a transfer member configured to form a transfer nip between itself and said image bearing member; and a fixing portion configured to fix on the recording material the toner image transferred on the recording material, said fixing portion including a fixing sleeve, a heater contacted to an inner surface of the fixing sleeve, and a pressing roller configured to form a fixing nip between itself and the heater through the fixing sleeve, wherein at least one of the fixing sleeve and the pressing roller is grounded through a series circuit consisting of a resistance element and a single rectifying element, and is grounded through a single capacitive element which is branched at a position between the resistance element and the single rectifying element.

6. An image forming apparatus according to claim 5, wherein the distance between the transfer portion and the fixing portion is shorter than the length of the recording material with respect to the conveyance direction of the recording material.

7. An image forming apparatus according to claim 6, wherein the capacitance value of the capacitive element is 3300 pF or more and 0.01 μF or less, and the resistance value of the resistance element is 1 MΩ or more and 7 MΩ or less.

* * * * *